US006680565B2

(12) United States Patent
Pyun et al.

(10) Patent No.: US 6,680,565 B2
(45) Date of Patent: Jan. 20, 2004

(54) CATHODE-RAY TUBE

(75) Inventors: Do-Houn Pyun, Yongin-si (KR); Won-Ho Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 74 days.

(21) Appl. No.: 09/983,003

(22) Filed: Oct. 17, 2001

(65) Prior Publication Data

US 2002/0105257 A1 Aug. 8, 2002

Related U.S. Application Data

(63) Continuation-in-part of application No. 09/724,186, filed on Nov. 27, 2000, now Pat. No. 6,459,196, which is a continuation of application No. 09/058,544, filed on Apr. 10, 1998, now Pat. No. 6,160,344.

(51) Int. Cl.[7] ..... H01J 61/30

(52) U.S. Cl. ..... 313/477 R; 313/408; 313/402; 220/2.1 A; 220/2.1 R

(58) Field of Search ..... 313/477 R, 408, 313/402, 403, 461, 473; 220/2.1 A, 2.1 R, 2.3 A

(56) References Cited

U.S. PATENT DOCUMENTS

| | | | | |
|---|---|---|---|---|
| 4,537,321 A | | 8/1985 | Tokita | 313/477 R |
| 4,537,322 A | | 8/1985 | Okada et al. | 313/477 R |
| 4,580,077 A | | 4/1986 | Bakker et al. | 313/477 |
| 4,924,140 A | | 5/1990 | Hirai et al. | 313/402 |
| 5,216,321 A | | 6/1993 | Kawamura et al. | 313/479 |
| 5,276,377 A | * | 1/1994 | van Nes et al. | 313/461 |
| 5,814,933 A | * | 9/1998 | Twata et al. | 313/477 R |
| 6,160,344 A | | 12/2000 | Cho et al. | 313/477 R |
| 6,433,470 B1 | * | 8/2002 | Watanabe et al. | 313/477 R |

FOREIGN PATENT DOCUMENTS

| | | |
|---|---|---|
| JP | 6-36710 | 2/1994 |
| JP | 6-44926 | 2/1994 |

* cited by examiner

*Primary Examiner*—Ashok Patel
(74) *Attorney, Agent, or Firm*—Christie, Parker & Hale, LLP

(57) ABSTRACT

A cathode ray tube includes a faceplate panel having a substantially flat exterior surface and a substantially concave interior surface having a phosphor screen, and a shadow mask behind the faceplate panel wherein the panel satisfies the following condition:

$1.2R \leqq Rp \leqq 8R$ where Rp is a curvature radius of the concave interior surface and R is 1.767×a diagonal width of an effective screen of the cathode ray tube.

The shadow mask has an effective electron beam-passing area having a plurality of apertures, wherein the shadow mask satisfies the following condition:

$$0.6 \leqq (Rs/Rp) \times (P_{H/S}/P_{H/C}) \leqq 1.25$$

where Rs is a curvature radius of the shadow mask, $P_{H/C}$ is a horizontal pitch of the apertures formed on a central portion of the shadow mask, and $P_{H/S}$ is a horizontal pitch of the apertures formed on a peripheral portion of the shadow mask.

27 Claims, 6 Drawing Sheets

CATHODE-RAY TUBE

CROSS REFERENCE TO RELATED APPLICATIONS AND PATENTS

This is a CIP of U.S. patent application Ser. No. 09/724,186 filed on Nov. 27, 2000 now U.S. Pat. No. 6,459,196, which is a Continuation Application of U.S. patent application Ser. No. 09/058,544, filed on Apr. 10, 1998, now U.S. Pat. No. 6,160,344. The above-named patent applications and patent are assigned to the same entity, and are incorporated herein by reference.

BACKGROUND OF THE INVENTION (a) Field of the Invention

The present invention relates to a cathode-ray tube (CRT) having a faceplate panel, and more particularly, to a CRT faceplate panel for producing a uniform and clear visual image across the entire area of a viewing screen.

(b) Description of the Related Art

Generally, CRTs are designed to reproduce a picture image on a screen of a faceplate panel by exciting phosphors coated on an interior surface of the faceplate panel with electron beams emitted from an electron gun and passing through apertures of a color-selecting shadow mask. The shadow mask ensures that each electron beam lands on the correct phosphor.

The faceplate panel is usually formed with a transparent glass plate having curved interior and exterior surfaces. These curved surfaces enable the panel to withstand the high-vacuum in the CRT and facilitate the landing of the electron beams on the phosphor screen.

However, such a faceplate panel involves a relatively broad light-reflecting exterior area in peripheral portions, thereby deteriorating the brightness of those areas and distorting the appearance of the picture.

To remedy this problem, a glass plate having flat interior and exterior surfaces has been developed to be used for the CRT panel. Such a panel employs a flat tension mask to perform the color-selecting function, the flat tension mask corresponding to the flat interior surface of the panel. The flat tension mask has predetermined horizontal and vertical tensional strengths to prevent the occurrence of a doming phenomenon.

However, in this type of panel, the visual images realized through the phosphor screen and refracted on the panel appear depressed to the user in the center portion of the viewing screen. The problem becomes more severe with larger-sized screens.

To overcome this drawback, Japanese Patent Laid-Open Publication Nos. H6-44926 and 6-36710 introduce a CRT faceplate panel, which is flat on an exterior surface but curved on an interior surface. However, the images realized through these inventions appear bulged outward. Further, because the peripheral portions of the panel are considerably thicker than the center portions, the brightness of the screen is deteriorated.

SUMMARY OF THE INVENTION

In one aspect of the present invention, a cathode ray tube includes a faceplate panel having a substantially flat exterior surface and a substantially concave interior surface having a phosphor screen, a funnel sealed to a the faceplate panel, the funnel having a neck portion, an electron gun mounted in the neck portion of the funnel, a shadow mask between the faceplate panel and the electron gun, the shadow mask having an effective electron beam-passing area comprising a plurality of apertures, and a deflection yoke around an outer periphery of the funnel, wherein the panel satisfies the following condition:

$$1.2R \leqq Rp \leqq 8R$$

where Rp is a curvature radius of the concave interior surface and R is 1.767×a diagonal width of an effective screen of the cathode ray tube, and the shadow mask satisfies the following condition:

$$0.6 \leqq (Rs/Rp) \times (P_{H/S}/P_{H/C}) \leqq 1.25$$

where Rs is a curvature radius of the shadow mask, $P_{H/C}$ is a horizontal pitch of the apertures formed on a central portion of the shadow mask, and $P_{H/S}$ is a horizontal pitch of the apertures formed on a peripheral portion of the shadow mask.

In another aspect of the present invention, a cathode ray tube includes a faceplate panel comprising a substantially flat exterior surface and a substantially concave interior surface having a phosphor screen, a funnel sealed to the faceplate panel,the funnel having a neck portion, an electron gun mounted in the neck portion of the funnel, a shadow mask between the faceplate panel and the electron gun, the shadow mask having an effective electron beam-passing area comprising a plurality of apertures, and a deflection yoke around an outer periphery of the funnel, wherein the panel satisfies the following condition:

$$1.2R \leqq Rp \leqq 8R$$

where Rp is a curvature radius of the concave interior surface and R is 1.767×a diagonal width of an effective screen of the cathode ray tube; and wherein the apertures formed on a central portion of the shadow mask are dot-shaped, and the apertures formed on a peripheral portion of the shadow mask are oval-shaped and elongated along a horizontal axis of the shadow mask, the shadow mask satisfying the following condition:

$$0.6 \leqq (Rs/Rp) \times (bs/as) \leqq 2.0$$

where "bs" is a horizontal radius of the apertures formed on the peripheral portion of the shadow mask, and "as" is a vertical radius of the apertures formed on the peripheral portion of the shadow mask.

In yet another aspect of the present invention, a cathode ray tube includes a faceplate panel comprising a substantially flat exterior surface and a substantially concave interior surface having a phosphor screen, a funnel sealed to the faceplate panel, the funnel having a neck portion, an electron gun mounted in the neck portion of the funnel, a shadow mask between the faceplate panel and the electron gun, the shadow mask having an effective electron beam-passing area comprising a plurality of apertures are formed, a deflection yoke placed around an outer periphery of the funnel, wherein the panel satisfies the following condition:

$$1.2R \leqq Rp \leqq 8R$$

where Rp is a curvature radius of the concave interior surface and R is 1.767×a diagonal width of an effective screen of the cathode ray tube; and the shadow mask satisfies the following condition:

$$0.8 \leqq (Rs/Rp) \times (P_{H/S}/P_{H/C}) \times (bs/as) \leqq 2.5$$

where Rs is a curvature radius of the shadow mask, $P_{H/C}$ is a horizontal pitch of the apertures formed on a central portion of the shadow mask, $P_{H/S}$ is a horizontal pitch of the apertures formed on a peripheral portion of the shadow mask, "bs" is a horizontal radius of the apertures formed on the peripheral portion of the shadow mask, and "as" is a vertical radius of the apertures formed on the peripheral portion of the shadow mask.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein.

DETAILED DESCRIPTION

Reference will now be made in detail to the preferred embodiment of the present invention, examples of which are illustrated in the accompanying drawings.

Figure 1:
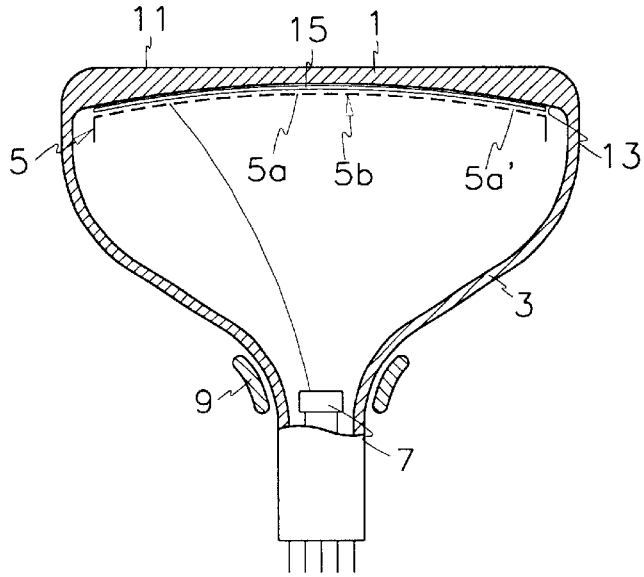
FIG. 1 is a partial sectional view of a CRT according to a preferred embodiment of the present invention.

FIG. 1 is a partial sectional view of a CRT according to a preferred embodiment of the present invention. As shown in FIG. 1, the inventive CRT includes a faceplate panel 1 having a phosphor screen 15, a funnel 3 sealed to the rear of the panel 1, a shadow mask 5 having an effective electron beam-passing area 5*b* with a plurality of apertures 5*a*,5*a*' placed behind the panel 1 with the phosphor screen 15 interposed therebetween, an electron gun 7 mounted within the neck of the funnel 3, and a deflection yoke 9 placed around the outer periphery of the funnel 3. In such a CRT, visual images are produced by exciting phosphors on the phosphor screen 15 with electron beams emitted from the electron gun 7 and passing through the shadow mask 5, the shadow mask 5 performing a color-selecting function.

The panel 1 has a flat exterior surface 11 to minimize reflection of external light and produce clear visual images even on the peripheral edges of the viewing screen. In contrast, the interior surface 13 of the panel 1 is concave. That is, the interior surface 13 of the panel 1 is curved in a direction toward the flat exterior surface 11. This curved interior surface 13 is an essential feature of an embodiment of the present invention for producing a uniform visual image across the entire area of the viewing screen.

The effective electron beam-passing area 5*b* of the shadow mask 5 has a curvature corresponding to the interior surface 13 of the panel 1. The inventive shadow mask 5 is formed using a pressing process. Accordingly, manufacture of the inventive shadow mask 5 is considerably easier and less costly than the flat tension mask used in the prior art CRT.

Figure 2:
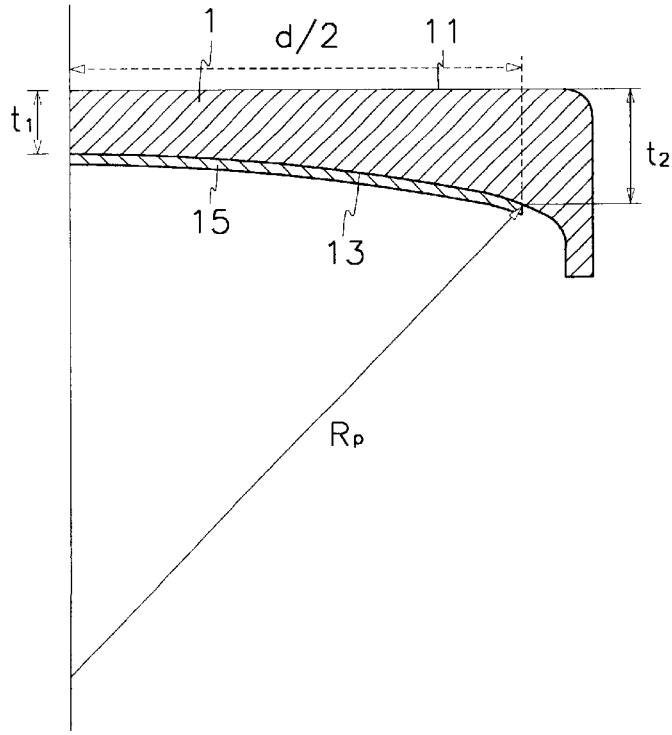
FIG. 2 is a diagram illustrating a visual image with respect to an interior surface of a panel depicted in FIG. 1.

Referring now to FIG. 2, shown is a diagram illustrating the relation between a visual image and the interior surface 13 of the panel 1. In the drawing, when the distance between the user and the exterior surface 11 is determined to be equal to the horizontal width h of the effective screen, the curved interior surface 13 should be set to satisfy the following mathematical formula 1. This prevents the phenomenon in which the effective screen appears to have a concave shape to the user, and results in a uniform visual image.

Referring to FIG. 2, $$y_1 - y_2 \leq 0 \tag{1}$$

where $y_1$ is the distance between the exterior surface 11 and a visual image line 17 on a central axis of the faceplate panel 1, and $y_2$ is the distance between the exterior surface 11 and the visual image line 17 at the periphery of the faceplate panel 1. In the above formula, $y_1 - y_2$ can be regarded as a measure of the degree of uniformity of the visual image.

The above effective screen is an imaginary plane on the exterior surface 11 when the phosphor screen 15 is vertically projected thereon. The reason that the distance between the user and the exterior surface 11 is determined to be the horizontal width h of the effective screen is because the relation between the viewing angle and uniformity of the visual image can be properly judged from that distance.

Figure 3:
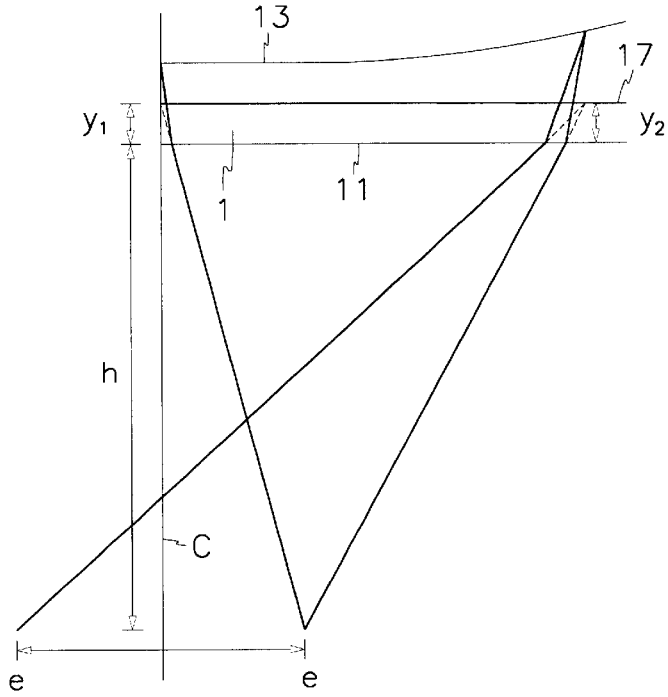
FIG. 3 is a partial sectional view illustrating a curvature radius of an interior surface of a panel depicted in FIG. 1.

FIG. 3 is a schematic diagram illustrating the relation between the curvature radius Rp of the interior surface 13 and the thicknesses $t_1$ and $t_2$ of the panel 1. Namely, $t_1$ indicates the thickness of the central portion of the panel 1 while $t_2$ indicates the thickness of the peripheral portion of the panel 1 at the diagonal corner of the effective screen. Because of the curvature of the interior surface 13, $t_2$ is greater than $t_1$.

The unit value R of the curvature radius Rp is given by the following mathematical formula 2:

$$R = 1.767 \times d \tag{2}$$

where d is the diagonal width of the effective screen. The above formula is derived from the published Technical Papers of the SID International Symposium in 1992 by Matsushita Corporation, Japan. The unit curvature radius R varies depending upon the employed panel type.

Figure 4:
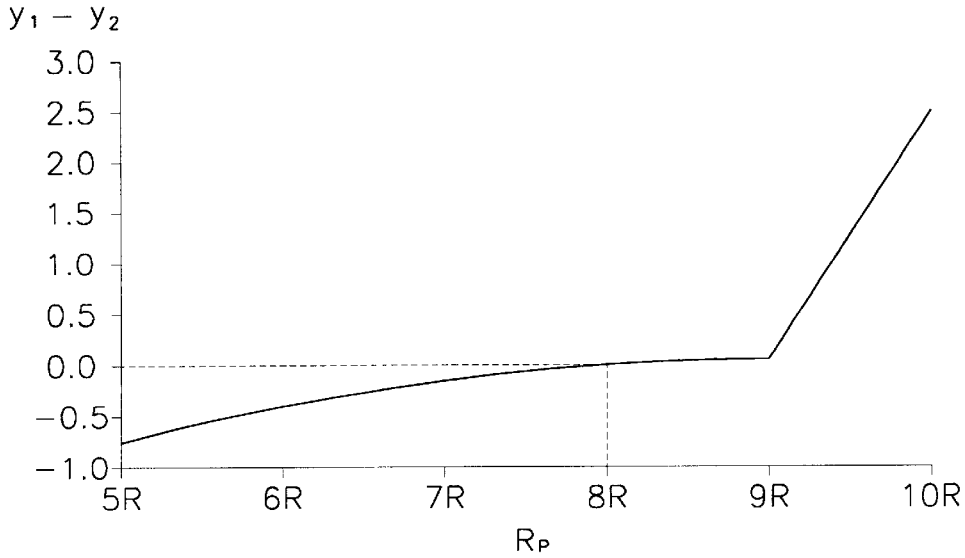
FIG. 4 is a graph illustrating a uniformity of a visual image with respect to the curvature radius of an interior surface of a panel depicted in FIG. 1.

FIG. 4 is a graph illustrating the relation between the uniformity $y_1 - y_2$ of the visual image and the curvature radius Rp of the interior surface 13 in a 17-inch CRT. As shown in the drawing, the mathematical formula 1 is satisfied in the range of 8R or less. This means that a uniform visual image can be obtained in the range of 8R or less. However, in a range exceeding 8R, the visual image appears to be depressed in the center of the viewing screen. This relation is also applicable to other type CRTs. Therefore, in this preferred embodiment, the curvature radius $R_P$ of the interior surface 13 of the panel 1 is determined to be in the range of 8R or less.

The resulting large thickness of the peripheral portion of the panel 1, however, acts to deteriorate brightness. Thus, in order to overcome such an undesirable effect, the ratio of light transmission at the periphery of the effective screen to light transmission at the center of the effective screen should be relatively high. As a result, in this preferred embodiment, the desired ratio of light transmission at the peripheral portion at the diagonal corner of the effective screen to light transmission at the center of the effective screen is determined to be 0.85 or greater. This value is adopted in consideration of the correlation among the panel weight, production cost and productivity.

Accordingly, a clear glass having a central light transmission rate of 85% or more can be used for the panel 1.

Measurement of the central light transmission rate of the clear glass panel is conducted using the following mathematical formula 3:

$$\text{Light Transmission Rate } (\%)=(e^{-\alpha t}-0.08)\times 100 \quad (3)$$

where $\alpha$=0.006090 and t is the central thickness of the panel.

Figure 5:
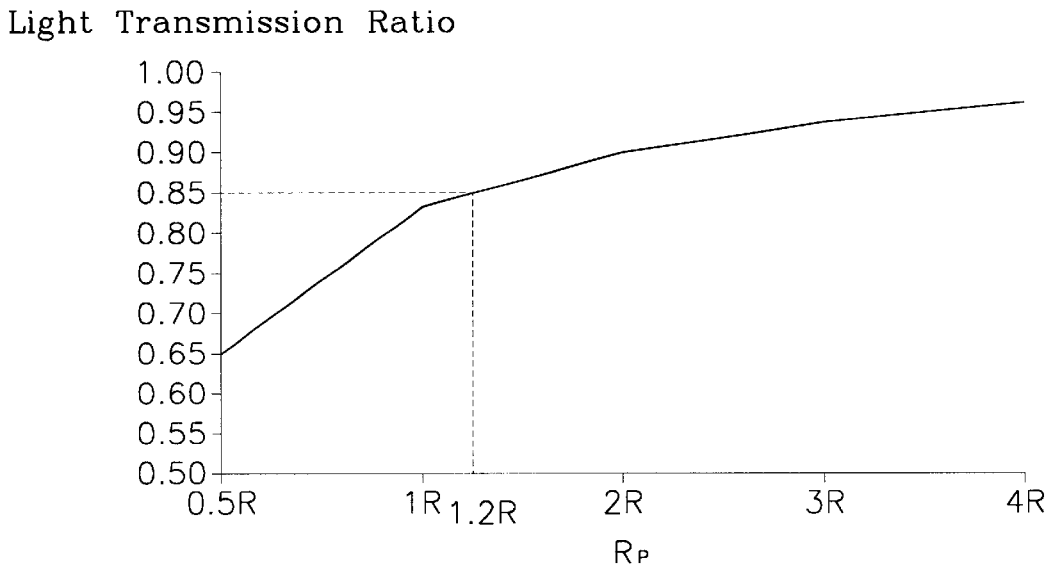
FIG. 5 is a graph illustrating a light transmission ratio at the center and periphery of a panel with respect to a curvature radius of an interior surface of a panel depicted in FIG. 1.

FIG. 5 is a graph illustrating the relation between the curvature radius Rp and the ratio of light transmission at the peripheral portion at the diagonal corner of the effective screen to the light transmission at the center of the effective screen. As shown in FIG. 5, when the desired light transmission ratio is determined to be 0.85 or greater, the curvature radius $R_P$ needed becomes 1.2R or more. Conversely, with a curvature radius $R_P$ of 1.2R or more, the light transmission ratio becomes 0.85 or greater, thereby producing good brightness. However, with a curvature radius $R_P$ of less than 1.2R, the light transmission ratio becomes less than 0.85 such that brightness is deteriorated.

Therefore, referring to FIGS. 4 and 5, the curvature radius $R_P$ of the interior surface 13 of the panel 1 according to a preferred embodiment of the present invention satisfies the following mathematical formula 4:

$$1.2R \leqq R_P \leqq 8R \quad (4)$$

where R=1.767×the diagonal width of the effective screen of the CRT.

When the curvature radius $R_P$ is in the above range, the phenomenon in which the visual image appears to be depressed in the center of the viewing screen can be prevented, such that good brightness can be obtained.

Panel types capable of satisfying the mathematical formula 4 are listed in Table 1.

TABLE 1

| | C (mm) | A (mm) | B (mm) |
|---|---|---|---|
| 15 inch | 10.5 | 34.7 | 13.65 |
| 17 inch | 11.5 | 35.7 | 15.10 |
| 19 inch | 12.0 | 36.2 | 16.03 |
| 25 inch | 13.0 | 37.2 | 18.22 |
| 29 inch | 14.0 | 38.2 | 20.00 |
| 32 inch | 15.0 | 39.2 | 21.74 |

where C is the central thickness $t_1$ of the panel 1, A is the peripheral thickness $t_2$ of the panel 1 at the diagonal corner of the effective screen when the light transmission ratio is 0.85, and B is the peripheral thickness $t_2$ of the panel 1 when the curvature radius $R_P$ is 8R.

Referring to Table 1, the peripheral thickness $t_2$ of the panel 1 at the end of the effective screen can be determined using the following mathematical formula 5. This range is given considering the correlation among the factors of thickness, light transmission ratio, and curvature radius.

Referring to Table 1:

$$B \leqq t_2 \leqq A \quad (5)$$

In the 17-inch panel, the thickness $t_2$ can be derived from mathematical formula 5 and Table 1 as 15.10 mm$\leqq t_2 \leqq$35.7 mm.

Figure 7:
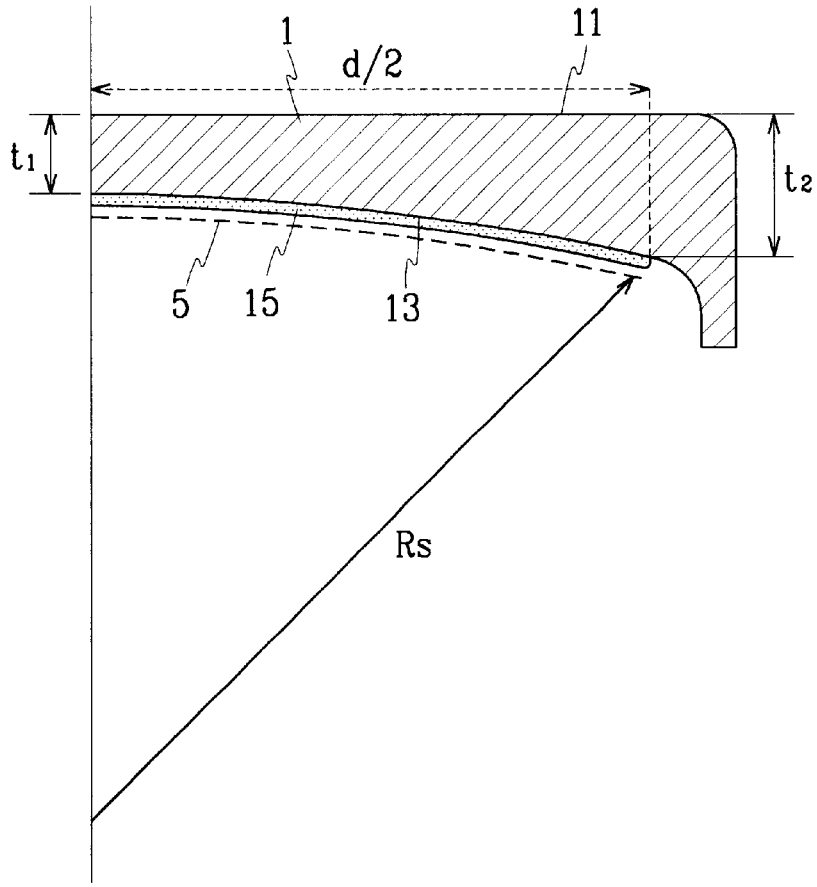
FIG. 7 is a partial sectional view illustrating a curvature radius of a shadow mask depicted in FIG. 1.

In addition, the range of curvature radius $R_P$ defined in mathematical formula 4 can be further limited in view of the characteristics of the shadow mask 5. The shadow mask 5 should have a curvature radius $R_S$ identical with or smaller than the curvature radius $R_P$ of the interior surface 13 of the panel 1 (see FIG. 7). However, when the shadow mask 5 is formed with a curvature radius of more than 4R, it is possible for the shadow mask 5 to become distorted.

Thus, the shadow mask 5 should have a curvature radius $R_S$ capable of satisfying the following mathematical formula 6, while the curvature radius $R_P$ of the panel 1 defined in the mathematical formula 4 should be limited by the following mathematical formula 7:

$$1.2R \leqq R_S \leqq 4R \quad (6)$$

$$1.2R \leqq R_P \leqq 4R \quad (7)$$

Figure 6:
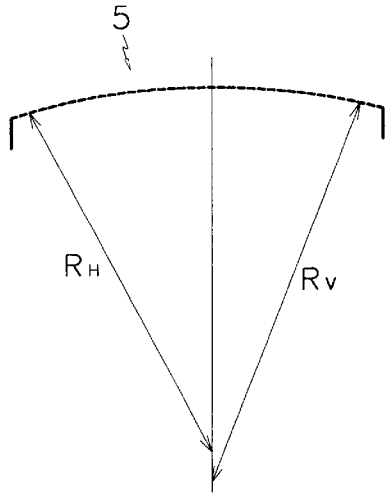
FIG. 6 is a diagram illustrating a horizontal curvature radius and a vertical curvature radius of a shadow mask depicted in FIG. 1.

FIG. 6 is a schematic diagram illustrating a horizontal curvature radius and a vertical curvature radius of the shadow mask 5. In order to minimize the occurrence of the doming phenomenon, it is preferable that the horizontal curvature radius $R_H$ of the shadow mask 5 as shown in FIG. 6 be identical with or smaller than the vertical curvature radius $R_V$. That is, the shadow mask 5 should satisfy the following mathematical formula 8:

$$R_H \leqq R_V \quad (8)$$

When the curvature radius $R_P$ is defined by the mathematical formula 7, B in Table 1 is changed into B' in Table 2.

TABLE 2

| | 15 inch | 17 inch | 19 inch | 25 inch | 29 inch | 32 inch |
|---|---|---|---|---|---|---|
| B'(mm) | 16.8 | 18.7 | 20.7 | 23.45 | 25.97 | 28.49 |

where B' is the peripheral thickness t2 of the panel 1 at the diagonal corner of the effective screen when the curvature radius $R_P$ is 4R.

Therefore, mathematical formula 5 can also be changed into mathematical formula 9:

$$B' \leqq t_2 \leqq A \quad (9)$$

Therefore, in the 17-inch panel, the thickness $t_2$ can be derived from mathematical formula 8 and Table 2 as 18.7 mm$\leqq t_2 \leqq$35.7 mm.

As described above, in the inventive CRT faceplate panel, the curvature radius $R_P$ of the interior surface 13 of the panel 1 is in the range of 1.2R$\leqq R_P \leqq$8R so that the visual image appears uniformly and clearly across the entire area of the viewing screen.

In addition, when designing a cathode ray tube according to the present invention, there is every possibility that the shadow mask 5 may be formed having a curvature radius Rs smaller than a curvature radius of the interior surface 13 of the faceplate panel 1 so as to obtain a stable manufacturing process of the shadow mask 5.

When the shadow mask 5 is formed having the smaller curvature radius and the normal sized beam-passing apertures 5*a* and 5*a*' are formed on the effective aperture area 5*b*, the electron beam deflecting function of the deflection yoke 9 should be enhanced to effectively converge electron beams passing the apertures 5*a*' located on the peripheral portion of the shadow mask 5.

When the deflecting function is not enhanced, since the electron beam-passing ratio at the peripheral portion of the shadow mask 5 is reduced, the brightness is deteriorated and the doming phenomenon of the shadow mask is increased. However, when the electron beam deflecting function of the deflection yoke 9 is enhanced, power consumption is increased.

Therefore, in the present invention, the-shadow mask 5 is designed as follows:

1. The horizontal pitches of the apertures are designed to be different from each other according to the locations where they are formed and the relationship between curvatures radiuses of the panel and the mask.

Figure 8:
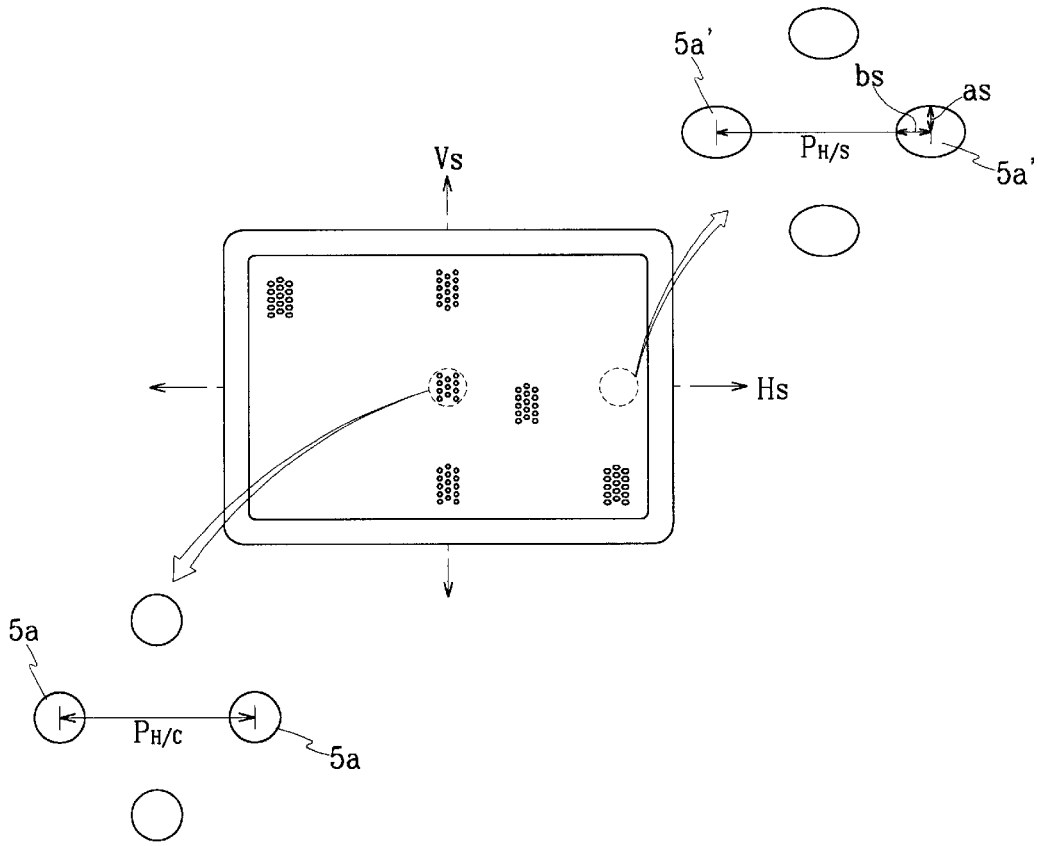
FIG. 8 is a diagram illustrating a relation between apertures formed on the central portion and apertures formed on the peripheral portion of a shadow mask according to a preferred embodiment of the present invention.

That is, as shown in FIG. 8, when the apertures 5*a* formed on the central portion of the shadow mask 5 have a predetermined horizontal pitch $P_{H/C}$, the apertures 5*a*' formed on the peripheral portion at the horizontal axis of the shadow mask 5 have a predetermined horizontal pitch $P_{H/S}$ greater than the pitch $P_{H/C}$. Preferably, the pitch $P_{H/S}$ is greater than 100% of the pitch $P_{H/C}$ and smaller than 120% of pitch $P_{H/C}$.

2. The shape of the apertures 5*a* and 5*a*' are designed to be different from each other in accordance with the relationship between the panel and the mask.

That is, the apertures 5*a* formed on the central portion of the shadow mask 5 are dot-shaped, while the apertures 5*a*' formed on the peripheral portion of the shadow mask are oval-shaped and elongated in the horizontal direction, so each of the apertures 5*a*' has a horizontal radius "bs" and a vertical radius "as". At this point, the vertical radius "as" of the apertures 5*a*' is identical to the radius of the apertures 5*a* formed on the central portion of the shadow mask 5.

Although it is preferable that the shadow mask be designed while satisfying the above two design conditions, it is also possible to design the shadow mask while satisfying only one of the design conditions.

It is more preferable that the shadow mask be designed according to the following mathematical formulas 10, 11 and 12.

$$0.6 \leqq (Rs/Rp) \times (P_{H/S}/P_{H/C}) \leqq 1.25 \quad (10)$$

$$0.6 \leqq (Rs/Rp) \times (bs/as) \leqq 2.0 \quad (11)$$

$$0.8 \leqq (Rs/Rp) \times (P_{H/S}/P_{H/C}) \times (bs/as) \leqq 2.5 \quad (12)$$

When the shadow mask having a flat exterior surface and a concave interior surface is designed satisfying the formulas, all the problems of mask rigidity, resolution and degree of beam landing tolerance, which are caused by the curvature difference between the mask and the panel, are solved.

The following Table 3 shows data obtained through a plurality of tests for illustrating a relationship between an interior diagonal curvature Rp of the panel and a diagonal curvature Rs of the mask and a relationship between the horizontal pitch $P_{H/S}$ at the central portion of the mask and the horizontal pitch $P_{H/S}$ at a peripheral portion of the mask.

TABLE 3

| No | Rs | Rp | $P_{H/S}$ | $P_{H/C}$ | V1 |
|---|---|---|---|---|---|
| 1 | 2 | 3.5 | 0.46 | 0.46 | 0.5714 |
| 2 | 2 | 3.5 | 0.46 | 0.49 | 0.6087 |
| 3 | 1.7 | 2.8 | 0.45 | 0.55 | 0.7421 |
| 4 | 3.1 | 2.8 | 0.47 | 0.55 | 0.9069 |
| 5 | 2 | 2.5 | 0.46 | 0.56 | 0.9739 |
| 6 | 2 | 2.5 | 0.46 | 0.584 | 1.1542 |
| 7 | 2.2 | 2.3 | 0.45 | 0.55 | 1.1691 |
| 8 | 2.2 | 2.3 | 0.45 | 0.58 | 1.2329 |
| 9 | 2.2 | 2.3 | 0.45 | 0.6 | 1.2754 |

In Table 3, V1 indicates a value of $(Rs/Rp) \times (P_{H/S}/P_{H/C})$ in the formula 10.

As shown in Table 3, when V1 is less than 0.6, beam accuracy may be reduced. That is, when the value V1 defining the relationship of the horizontal pitches $P_{H/S}$ and $P_{H/C}$ of the central and peripheral apertures 5*a* and 5*a*' with respect to the curvature radiuses Rp and Rs of the panel and the mask is less than 0.6, the beam accuracy may be reduced since a size of the electron beam as it goes to the peripheral portion becomes larger because of the deflection effect and the variation in the focus length. This also causes the problem of the mask rigidity.

It is further noted that when V1 is greater than 1.25, since the horizontal pitch $P_{H/S}$ too long when compared with the interior curvature radiuses Rp and Rs of the panel and the mask, appropriate electron beam-passing apertures cannot be formed within the effective aperture area 5*b*, thereby deteriorating the resolution.

In addition, it is further noted that it is more preferable that V1 be set according to the following formula 13.

$$0.75 \leqq (Rs/Rp) \times (P_{H/S}/P_{H/C}) \leqq 1.20 \quad (13)$$

The following Table 4 shows data obtained through a plurality of tests for illustrating a relationship between an interior diagonal curvature Rp of the panel and a diagonal curvature Rs of the mask and a relationship between the horizontal radius "bs" and the vertical radius "as" of the oval-shaped peripheral apertures.

TABLE 4

| No | Rs | Rp | as | bs | V2 |
|---|---|---|---|---|---|
| 1 | 2.1 | 3.5 | 0.055 | 0.058 | 0.6327 |
| 2 | 1.7 | 2.8 | 0.06 | 0.065 | 0.6577 |
| 3 | 2 | 2.5 | 0.058 | 0.059 | 0.813 |
| 4 | 2.2 | 2.3 | 0.053 | 0.055 | 0.9926 |
| 5 | 3.1 | 4 | 0.06 | 0.083 | 1.0721 |
| 6 | 2 | 2.2 | 0.058 | 0.08 | 1.2539 |
| 7 | 2.2 | 2.3 | 0.053 | 0.079 | 1.4258 |
| 8 | 3.1 | 4 | 0.06 | 0.166 | 2.1442 |
| 9 | 2.2 | 2.3 | 0.053 | 0.12 | 2.1657 |

In Table 4, V2 indicates a value of (Rs/Rp)×(bs/as) in the formula 11.

As shown in Table 4, it can be noted that when the value of V2 is less than 0.6, beam accuracy may be reduced. That is, when the value V2 defining the relationship of the horizontal and vertical radiuses "bs" and "as" of the peripheral apertures with respect to the curvature radiuses Rp and Rs of the panel and the mask is less than 0.6, beam accuracy may be reduced since the size of the electron beam as it goes to the peripheral portion becomes larger because of the deflection effect and the variation in the focus length.

It is further noted that when V2 is greater than 2, since the horizontal radius of the peripheral apertures is too long when compared with the interior curvature radiuses Rp and Rs of the panel and the mask, appropriate electron beam-passing apertures cannot be formed within the effective aperture area 5*b*, thereby deteriorating the resolution.

In addition, it is further noted that it is more preferable that V2 is set according to the following formula 14.

$$0.9 \leqq (Rs/Rp) \times (bs/as) \leqq 1.5 \quad (14)$$

The following Table 5 shows data obtained through a plurality of tests for illustrating a relationship between an interior diagonal curvature Rp of the panel and a diagonal curvature Rs of the mask, a relationship between the horizontal pitch $P_{H/S}$ at the central portion of the mask and the horizontal pitch $P_{H/C}$ at a peripheral portion of the mask, and a relationship between the horizontal radius "bs" and the vertical radius "as" of the oval-shaped peripheral apertures.

TABLE 5

| No | Rs (R) | R (R) | $P_{H/C}$ (mm) | $P_{H/S}$ (mm) | as (mm) | ba (mm) | V3 |
|---|---|---|---|---|---|---|---|
| 1 | 2.1 | 3.5 | 0.44 | 0.49 | 0.055 | 0.058 | 0.7 |
| 2 | 1.7 | 2.8 | 0.45 | 0.55 | 0.06 | 0.065 | 0.8 |
| 3 | 2 | 2.5 | 0.46 | 0.56 | 0.058 | 0.059 | 1.0 |
| 4 | 2.2 | 2.3 | 0.45 | 0.55 | 0.053 | 0.055 | 1.3 |
| 5 | 3.1 | 4 | 0.47 | 0.55 | 0.06 | 0.083 | 1.2 |
| 6 | 2 | 2.2 | 0.46 | 0.537 | 0.058 | 0.08 | 1.5 |
| 7 | 2.1 | 2.3 | 0.45 | 0.58 | 0.053 | 0.079 | 1.8 |
| 8 | 2.2 | 2.3 | 0.45 | 0.6 | 0.053 | 0.12 | 2.8 |

In Table 5, V2 indicates a value of $0.8 \leqq (Rs/Rp) \times (P_{H/S}/P_{H/C}) \times (bs/as) \leqq 2.5$ in the formula 12.

As shown in Table 5, it can be noted that when the value of V3 is less than 0.8, beam accuracy may be reduced. That is, when the value V3 defining the relationship of the horizontal and vertical radiuses "bs" and "as" of the peripheral apertures and the horizontal pitches $P_{H/S}$ and $P_{H/C}$ of the central and peripheral apertures 5*a* and 5*a*' with respect to the curvature radiuses Rp and Rs of the panel and the mask is less than 0.6, the beam accuracy may be reduced since a size of the electron beam as it goes to the peripheral portion becomes larger because of the deflection effect and the variation in the focus length.

It is further noted that when V3 is greater than 2.5, since the horizontal radius of the peripheral apertures is too long when compared with the interior curvature radiuses Rp and Rs of the panel and the mask, appropriate electron beam-passing apertures cannot be formed within the effective aperture area 5*b*, thereby deteriorating the resolution.

In addition, it is further noted that it is more preferable that V3 be set according to the following formula 14.

$$1.0 \leqq (Rs/Rp) \times (bs/as) \times (P_{H/S}/P_{H/C}) \leqq 1.8 \quad (15)$$

In addition, the following Table 6 shows data regarding the improvement in the electron beam-passing ratio when the peripheral apertures 5*a*' are formed in an oval-shape elongated in the horizontal direction.

TABLE 6

| No | R/I (%) | $P_{V/S}$ | $P_{H/S}$ | as | Bs | S/A | H/A | T (%) |
|---|---|---|---|---|---|---|---|---|
| 1 | 100 | 0.27 | 0.4677 | 0.058 | 0.058 | 0.1263 | 0.0211 | 16.7 |
| 2 | 105 | 0.27 | 0.4910 | 0.058 | 0.0697 | 0.1326 | 0.0254 | 19.2 |
| 3 | 110 | 0.27 | 0.5144 | 0.058 | 0.0814 | 0.1389 | 0.0297 | 21.4 |
| 4 | 115 | 0.27 | 0.5378 | 0.058 | 0.0931 | 0.1452 | 0.0339 | 23.4 |
| 5 | 120 | 0.27 | 0.5612 | 0.058 | 0.1048 | 0.1515 | 0.2520 | 25.2 |

Figure 9:
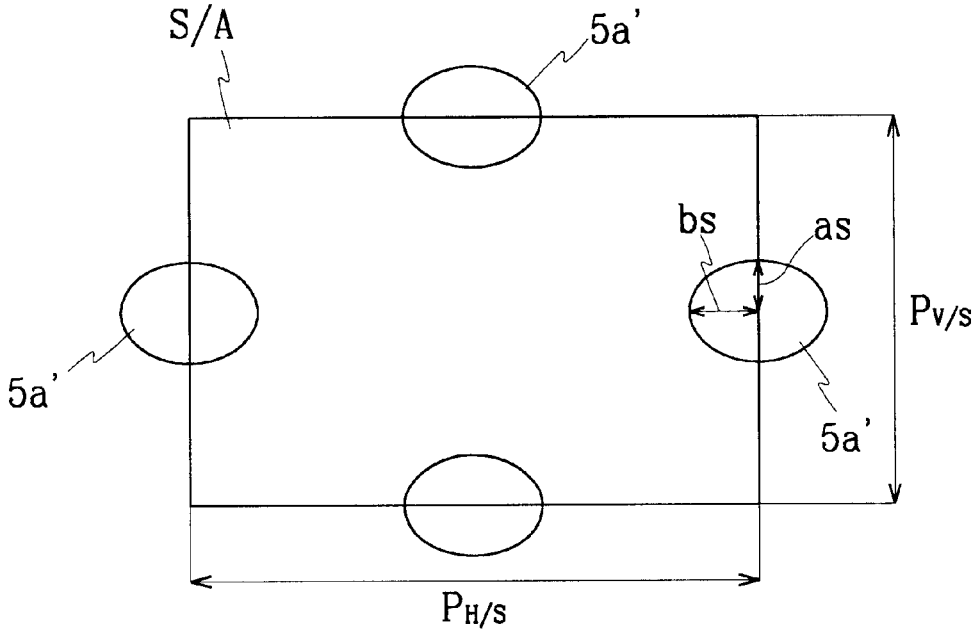
FIG. 9 is a diagram illustrating an electron beam-passing ratio of a shadow mask according to a preferred embodiment of the present invention.

In table 6, R/I indicates an increased ratio in the horizontal pitch $P_{H/S}$, $P_{V/S}$ indicates a vertical pitch of the peripheral apertures 5*a*', S/A denotes an area of an rectangular portion depicted in a broken line in FIG. 9, H/A indicates a whole area of the peripheral apertures 5*a*' included within the rectangular portion, and T denotes the electron beam-passing ratio with respect to the whole area of the peripheral apertures 5*a*'. The electron beam-passing ratios T are described as a percentage obtained according to the following equation:

$$((H/A) \times 100))/(S/A)$$

That is, S/A is regarded as an area on which the electron beams strike, and H/A is regarded as an electron beam-passing area within the area S/A.

As shown by data T in Table 6, it can be noted that the electron beam-passing ratio is increased as the horizontal radius "bs" is increased by the increase of the horizontal pitch $P_{H/S}$ of the apertures 5*a*'.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A cathode ray tube comprising:

a faceplate panel comprising a substantially flat exterior surface and a substantially concave interior surface having a phosphor screen;

a funnel sealed to a the faceplate panel, the funnel having a neck portion;

an electron gun mounted in the neck portion of the funnel;

a shadow mask between the faceplate panel and the electron gun, the shadow mask having an effective electron beam-passing area comprising a plurality of apertures; and a deflection yoke around an outer periphery of the funnel;

wherein the panel satisfies the following condition:

$$1.2R \leqq Rp \leqq 8R$$

where Rp is a curvature radius of the concave interior surface and R is 1.767×a diagonal width of an effective screen of the cathode ray tube; and the shadow mask satisfies the following condition:

$$0.6 \leqq (Rs/Rp) \times (P_{H/S}/P_{H/C}) \leqq 1.25$$

where Rs is a curvature radius of the shadow mask, $P_{H/C}$ is a horizontal pitch of the apertures formed on a central portion of the shadow mask, and $P_{H/S}$ is a horizontal pitch of the apertures formed on a peripheral portion of the shadow mask.

2. A cathode ray tube of claim 1 wherein the concave interior surface has a curvature radius Rp satisfying the following condition:

$$1.2R \leqq Rp \leqq 4R$$

where R=1.767×a diagonal width of the effective screen of the cathode ray tube.

3. A cathode ray tube of claim 1 wherein a light transmissivity at a central portion of the panel is 85% or greater.

4. A cathode ray tube of claim 1 wherein a ratio of light transmission at a peripheral portion on a diagonal end of the phosphor screen to light transmission at a central portion of the effective screen is 0.85 or greater.

5. A cathode ray tube of claim 4 wherein a light transmissivity at a central portion of the panel is 85% or greater.

6. A cathode ray tube of claim 1 wherein the faceplate panel satisfies the following condition:

$$y_1 - y_2 \leqq 0$$

where $y_1$ is a distance between the exterior surface and a visual image on a central axis of the faceplate panel and $y_2$ is a distance between the exterior surface and a visual image on a periphery of the faceplate panel.

7. A cathode ray tube of claim 1 wherein the shadow mask has a curvature radius Rs satisfying the following condition:

$$1.2R \leqq Rs \leqq 4R$$

where R=1.767×a diagonal width of the effective screen.

8. A cathode ray tube of claim 7 wherein a horizontal curvature radius of the shadow mask is identical to or less than a vertical curvature radius of the shadow mask.

9. A cathode ray tube of claim 1 wherein the shadow mask further satisfies the following condition:

$$0.75 \leqq (Rs/Rp) \times (P_{H/S}/P_{H/C}) \leqq 1.20.$$

10. A cathode ray tube comprising:

a faceplate panel comprising a substantially flat exterior surface and a substantially concave interior surface having a phosphor screen;

a funnel sealed to the faceplate panel, the funnel having a neck portion;

an electron gun mounted in the neck portion of the funnel;

a shadow mask between the faceplate panel and the electron gun, the shadow mask having an effective electron beam-passing area comprising a plurality of apertures; and a deflection yoke around an outer periphery of the funnel;

wherein the panel satisfies the following condition:

$$1.2R \leqq Rp \leqq 8R$$

where Rp is a curvature radius of the concave interior surface and R is 1.767×a diagonal width of an effective screen of the cathode ray tube; and wherein the apertures formed on a central portion of the shadow mask are dot-shaped, and the apertures formed on a peripheral portion of the shadow mask are oval-shaped and elongated along a horizontal axis of the shadow mask, the shadow mask satisfying the following condition:

$$0.6 \leqq (Rs/Rp) \times (bs/as) \leqq 2.0$$

where "bs" is a horizontal radius of the apertures formed on the peripheral portion of the shadow mask, and "as" is a vertical radius of the apertures formed on the peripheral portion of the shadow mask.

11. A cathode ray tube of claim 10 wherein the concave interior surface has a curvature radius Rp satisfying the following condition:

$$1.2R \leqq Rp \leqq 4R$$

where R=1.767×the diagonal width of an effective screen of the cathode ray tube.

12. A cathode ray tube of claim 10 wherein a light transmissivity at a central portion of the panel is 85% or greater.

13. A cathode ray tube of claim 10 wherein the ratio of light transmission at a peripheral portion on a diagonal end of the phosphor screen to light transmission at a central portion of the phosphor screen is 0.85 or greater.

14. A cathode ray tube of claim 13 wherein a light transmissivity at a central portion of the panel is 85% or greater.

15. A cathode ray tube of claim 10 wherein the faceplate panel satisfies the following condition:

$$y_1 - y_2 \leqq 0$$

where $y_1$ is a distance between the exterior surface and a visual image on a central axis of the faceplate panel and $y_2$ is a distance between the exterior surface and a visual image on a periphery of the faceplate panel.

16. A cathode ray tube of claim 10 wherein the shadow mask has a curvature radius Rs satisfying the following condition:

$$1.2R \leqq Rs \leqq 4R$$

where R=1.767×the diagonal width of the effective screen.

17. A cathode ray tube of claim 16 wherein a horizontal curvature radius of the shadow mask is identical to or less than a vertical curvature radius of the shadow mask.

18. A cathode ray tube of claim 10 the shadow mask further satisfies the following condition:

$$0.9 \leqq (Rs/Rp) \times (bs/as) \leqq 1.5.$$

19. A cathode ray tube comprising:

a faceplate panel comprising a substantially flat exterior surface and a substantially concave interior surface having a phosphor screen;

a funnel sealed to the faceplate panel, the funnel having a neck portion;

an electron gun mounted in the neck portion of the funnel;

a shadow mask between the faceplate panel and the electron gun, the shadow mask having an effective electron beam-passing area comprising a plurality of apertures are formed;

a deflection yoke placed around an outer periphery of the funnel;

wherein the panel satisfies the following condition:

$$1.2R \leqq Rp \leqq 8R$$

where Rp is a curvature radius of the concave interior surface and R is 1.767×a diagonal width of an effective screen of the cathode ray tube; and the shadow mask satisfies the following condition:

$$0.8 \leqq (Rs/Rp) \times (P_{H/S}/P_{H/C}) \times (bs/as) \leqq 2.5$$

where Rs is a curvature radius of the shadow mask, $P_{H/C}$ is a horizontal pitch of the apertures formed on a central portion of the shadow mask, $P_{H/S}$ is a horizontal pitch of the apertures formed on a peripheral portion of the shadow mask, "bs" is a horizontal radius of the apertures formed on the peripheral portion of the shadow mask, and "as" is a vertical radius of the apertures formed on the peripheral portion of the shadow mask.

20. A cathode ray tube of claim 19 wherein the concave interior surface has a curvature radius Rp satisfying the following condition:

$$1.2R \leqq Rp \leqq 4R$$

where R=1.767×the diagonal width of an effective screen of the cathode ray tube.

21. A cathode ray tube of claim 19 wherein a light transmissivity at a central portion of the panel is 85% or greater.

22. A cathode ray tube of claim 19 wherein the ratio of light transmission at a peripheral portion on a diagonal end of the phosphor screen to light transmission at a central portion of the phosphor screen is 0.85 or greater.

23. A cathode ray tube of claim 22 wherein a light transmissivity at a central portion of the panel is 85% or greater.

24. A cathode ray tube of claim 19 wherein the faceplate panel satisfies the following condition:

$$y_1 - y_2 \leqq 0$$

where $y_1$ is a distance between the exterior surface and a visual image on a central axis of the faceplate panel and $y_2$ is a distance between the exterior surface and a visual image on a periphery of the faceplate panel.

25. A cathode ray tube of claim 19 wherein the shadow mask has a curvature radius Rs satisfying the following condition:

$$1.2R \leqq Rs \leqq 4R$$

where R=1.767×the diagonal width of the effective screen.

26. A cathode ray tube of claim 25 wherein a horizontal curvature radius of the shadow mask is identical to or less than a vertical curvature radius of the shadow mask.

27. A cathode ray tube of claim 19 wherein the shadow mask further satisfies the following condition:

$$1.0 \leqq (Rs/Rp) \times (P_{H/S}/P_{H/C}) \times (bs/as) \leqq 1.8.$$

* * * * *